US007610886B2

(12) United States Patent
von Schimonsky

(10) Patent No.: US 7,610,886 B2
(45) Date of Patent: Nov. 3, 2009

(54) FORCE TRANSMITTING ARRANGEMENT FOR A VALVE DRIVE OF AN INTERNAL COMBUSTION ENGINE

(75) Inventor: Lothar von Schimonsky, Gerhardshofen (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/457,563

(22) Filed: Jul. 14, 2006

(65) Prior Publication Data

US 2007/0012273 A1 Jan. 18, 2007

Related U.S. Application Data

(60) Provisional application No. 60/699,130, filed on Jul. 14, 2005.

(51) Int. Cl.
*F01L 1/14* (2006.01)

(52) U.S. Cl. ..... 123/90.48; 123/90.52; 123/90.59

(58) Field of Classification Search ..... 123/90.48, 123/90.52, 90.59
See application file for complete search history.

(56) References Cited

U.S. PATENT DOCUMENTS 4,231,267 A * 11/1980 Van Slooten ..... 74/569
4,462,364 A 7/1984 Kodama
2002/0096136 A1 7/2002 Spath et al.

FOREIGN PATENT DOCUMENTS

DE 19754016 6/1999
DE 10342642 5/2005

* cited by examiner

*Primary Examiner*—Zelalem Eshete
(74) *Attorney, Agent, or Firm*—Volpe and Koenig, P.C.

(57) ABSTRACT

A force transmitting device (4) for a valve drive (1) of an internal combustion engine (2) with a hydraulic valve lash compensating device (6) is provided. The force transmitting device (4) has a hollow cylindrical compensating piston (13), which on one end defines a working chamber (35) of the valve lash compensating device (6) and on the other end encloses an internal hydraulic medium reservoir (15) used to supply the working chamber (35). This is connected to a hydraulic medium supply (16) of the internal combustion engine (2) and is protected from a return flow of hydraulic medium in the direction of the hydraulic medium supply (16) by means of a valve plate (26), which can be pressurized and which can move axially, in that the valve plate (26) interacts in a sealing way with an axial annular surface (28) of the compensating piston (13) for a non-pressurized hydraulic medium supply (16). Here, the valve plate (26) should have one or more openings (34), which connect the internal hydraulic medium reservoir (15) to an external hydraulic medium reservoir (31) for a non-pressurized hydraulic medium supply (16).

10 Claims, 3 Drawing Sheets

FORCE TRANSMITTING ARRANGEMENT FOR A VALVE DRIVE OF AN INTERNAL COMBUSTION ENGINE

CROSS-REFERENCE TO RELATED APPLICATIONS

This application is a non-provisional of U.S. patent application No. 60/699,130 filed Jul. 14, 2005.

FIELD OF THE INVENTION

The invention relates to a force transmitting arrangement for a valve drive of an internal combustion engine with a hydraulic valve lash compensating device. The force transmitting arrangement has a hollow cylindrical compensating piston, which defines, on one end, a working chamber of the valve lash compensating device and encloses, on the other end, an internal hydraulic medium reservoir used for supplying the working space. This is connected to a hydraulic medium supply of the internal combustion engine and protected against return flow of hydraulic medium in the direction of the hydraulic medium supply by means of an axially moving valve plate, which can be acted upon by pressure. In this respect, the valve plate interacts in a sealing way with an axial ring surface of the compensating piston for a non-pressurized hydraulic medium supply.

BACKGROUND OF THE INVENTION

Such force transmitting devices are known to someone skilled in the art of valve controllers with hydraulic valve lash compensation and are embodied according to the architecture of the internal combustion engine. Thus, the so-called "overhead camshaft," also known as "OHC," construction for a valve drive with a camshaft in the cylinder head for the most part uses a slaved cup tappet, valve lifter or rocker arm, as well as a stationary pivot bearing for finger levers, each with hydraulic valve lash compensation.

In addition, such force transmitting devices also find multiple uses in the so-called "overhead valve" valve drive arrangement known in short as "OHV" for predominantly large-volume internal combustion engines embodied as V engines. In the OHV arrangement, the valve drive is characterized by a camshaft, which is mounted in the engine block of the internal combustion engine in the vicinity of the crankshaft and whose cam lobes are picked up by longitudinally moving tappets equipped for the most part with hydraulic valve lash compensation as force transmitting devices and are converted into a lifting motion of the corresponding tappet connected to the cam. The lifting motion of the tappet is typically transmitted via a tappet rod, which actuates a rocker arm mounted in the cylinder head of the internal combustion engine, to one or more gas-exchange valves allocated to the tappet.

The known advantages of a hydraulic and thus automatic valve lash compensating device include, in particular, the elimination of the valve lash setting during the initial installation and maintenance of the internal combustion engine, its quiet running, and favorable exhaust gas emissions. However, these advantages can be realized completely only under the prerequisite that the hydraulic valve lash compensating device is operational or ready to operate in all operating states, including when the internal combustion engine is stopped and when started. The essential basis here is obviously an adequate supply of hydraulic medium to the valve lash compensating device. For this purpose, the hydraulic medium is fed during the operation of the internal combustion engine from a hydraulic medium pump via supply lines to a compensating piston of the valve lash compensating device, with the compensating piston defining a hydraulic cushion of a working space used for transmitting movements and forces. The working space is variable in volume, because the compensating piston is always aiming to adjust the height of the hydraulic cushion enclosed by the working space, so that mechanical play in the valve drive is eliminated during the lift-free base circle phase of the cam. The compensating piston typically has a hollow cylindrical shape and encloses a hydraulic medium reservoir, which supplies the working chamber with hydraulic medium via a non-return valve during valve lash compensation movements, i.e., when the working chamber is expanding. Here, it has proven to be useful if the volume of the hydraulic medium reservoir equals a multiple of the volume of the working chamber, in order to reliably rule out undesired suctioning of air or gas bubbles into the working chamber under all operating conditions of the internal combustion engine.

In connection with this, a starting process of a cold internal combustion engine, which typically would have been turned off with one or more open gas-exchange valves, represents an especially critical operating state, so that the compensating piston of the corresponding valve lash compensating devices are lowered partially or completely due to hydraulic medium being largely forced from the working chamber under the effect of the gas-exchange valve spring and according to the duration of the intermediate standstill phase of the internal combustion engine. In addition, the hydraulic medium pump delivers no or only an inadequate hydraulic medium volume flow to the compensating piston during the starting process. In this respect, essentially the sole task of the hydraulic medium reservoir is to completely satisfy the considerable hydraulic medium requirements of the working chamber during its expansion from the lowered position of the compensating piston into its working position.

An inadequately large or an inadequately filled hydraulic medium reservoir would necessarily lead to suctioning of air or gas bubbles into the working chamber. The consequences of a working chamber containing air or gas bubbles for the valve drive function during starting and operation of the internal combustion engine are known to someone skilled in the art and are perceived audibly as disruptive as so-called valve tapping primarily due to high contact velocities of the gas-exchange valve during their closing process.

The requirement for a sufficiently large hydraulic medium reservoir also stands increasingly in conflict with the goal of further reducing the installation space and/or the mass of the force transmitting device or for expanding the functionality of the force transmitting device while not changing the installation space. The latter case includes, in particular, variable force transmitting devices, which are embodied as reversible force transmitting devices and which each transmit strokes from different cams selectively to the gas-exchange valve according to the switching state of their coupling means and/or can completely mask the stroke of one cam. Thus, for example, for switchable push rod valve trains in an OHV arrangement, it is typical to interleave cam follower parts, which can be displaced longitudinally and which can be coupled with each other, one in the other, so that the outer and connection geometry of the cam follower can remain essentially unchanged. However, this normally requires a reduction in installation space of the hydraulic valve lash compensating device and consequently a reduction in volume of the hydraulic medium reservoir enclosed by the compensating piston with the previously explained risks and the consequences of an insufficient hydraulic medium supply to the working chamber.

In the state of the art, there have already been approaches for solving the problems named above. Thus, for example, in U.S. Pat. No. 4,462,364, which is considered a class-defining invention, as well as in DE 197 54 016 A1, retaining means have been proposed, which should prevent the draining of the hydraulic medium reservoir. In the non-pressurized state of the hydraulic medium supply, these retaining means completely enclose the hydraulic medium reservoir found in the compensating piston, whereby a partial or complete loss of hydraulic medium from the compensating piston can be prevented, especially for an installation position of the force transmitting device suitable for the force of gravity. However, simultaneously, the hydraulic medium volume made available to the working chamber is restricted by the size of this internal hydraulic medium reservoir. In this respect, these retaining means might not be suitable especially for switchable cam followers with installation space-reduced compensating pistons, in order to guarantee a complete refilling of the working chamber primarily during the starting phase of the engine.

SUMMARY

Therefore, the object of the invention is to provide a force transmitting device of the type named above, so that the cited disadvantages can be overcome with simple means. Accordingly, a sufficiently large hydraulic medium reservoir protected from draining is made available to the working chamber of the valve lash compensating device at all times, in order to guarantee, in particular, starting and warm running phases of the internal combustion engine that are free from valve tapping.

According to the invention, this objective is met by the features of the characterizing portion of claim 1, while advantageous improvements and constructions are to be taken from the subordinate claims. Accordingly, the valve plate has one or more openings, which connect the internal hydraulic medium reservoir to an external hydraulic medium supply for a non-pressurized hydraulic medium supply. The hydraulic medium reservoir expanded in this way and protected by the valve plate from a return flow of hydraulic medium in a direction of the hydraulic medium supply makes available to the working chamber, especially for a completely lowered compensating piston, a sufficiently large hydraulic medium volume for expansion of the working chamber without air or gas bubbles by returning the compensating piston into its valve lash free working position. Here, the external hydraulic medium reservoir is understood preferably, but not exclusively, to be cavities of adjacent valve train components.

In another construction of the invention, the valve plate is arranged between a base of a piston top part, which faces the compensating piston and which is supported on one end section of the compensating piston, and the annular surface of the compensating piston facing the base. Here, the valve plate is enclosed on an outer peripheral surface with a sealing gap by an inner sleeve surface of the compensating piston and/or the piston top part. The compensating piston can also be produced especially advantageously such that the annular surface is formed by a cylindrical depression on the end section of the compensating piston.

Furthermore, the axially and radially sealing valve plate can have an outer peripheral surface, which tapers in the direction of the annular surface and which defines an annular space in common with the annular surface. The annular space is preferably connected to the hydraulic medium supply via at least one front-end recess on the end section of the compensating piston and is used for displacing the valve plate in its operating position, in that the valve plate is forced in a direction of the base of the piston top part when the internal combustion engine is running. In contrast, when the internal combustion engine is stopped and the hydraulic medium supply is not pressurized, the valve plate contacts the annular surface in a sealing way. This can happen only under the effect of the force of gravity according to the installation position of the force transmitting device or can also be supported by a spring force acting on the valve plate.

In an especially preferred improvement of the invention, a flow of hydraulic medium directed towards the external hydraulic medium reservoir shall make available only a throttled hydraulic medium path when the valve plate is in contact with the base of the piston top part. Consequently, the valve plate with expanded functionality acts as a control element of a 3/2 path valve, which acts independently via hydraulic medium pressure and which controls the hydraulic connections between three ports in its two positions. These ports involve the hydraulic medium supply as well as the internal and the external hydraulic medium reservoir. Thus, in a first position of the valve plate corresponding to when the internal combustion engine is stopped, a return flow of hydraulic medium both from the internal and also from the external hydraulic medium reservoir is prevented, while the hydraulic medium reservoirs communicate with each other in an essentially throttle-free way and are made available to the working chamber. In contrast, in the previously named operating position, in which it contacts the base of the piston top part, the valve plate is located in its second position. In this second position, on one hand, hydraulic medium can be led from the hydraulic medium supply into the internal hydraulic medium reservoir enclosed by the compensating piston for continuous supply to the working chamber. On the other hand, a flow of hydraulic medium directed towards the external hydraulic medium reservoir is throttled. Such a throttling is useful when this flow of hydraulic medium is used not only for refilling the external hydraulic medium reservoir, but also for lubricating adjacent valve train components, without generating a significant pressure drop in the hydraulic medium supply.

The throttled hydraulic medium path comprises one or more radial channels, which extend in the base and/or in a front side of the valve plate facing the base and which connects an annular channel running in the base and/or in the base-side end of the valve plate, with the openings of the valve plate opening into this annular channel, to an axial opening of the piston top part. Accordingly, throttling of the flow of the hydraulic medium can be realized simply and economically preferably through non-cutting shaping of the radial channels or the annular channel in the distributor head or the base, while the essentially throttle-free openings of the valve plate can also be produced economically through drilling or stamping.

Furthermore, the force transmitting device can be provided as a tappet, which is mounted in the internal combustion engine so that it can move longitudinally and which transmits the stroke of a cam to a tappet rod mounted for pivoting in the piston top part. Here, the tappet rod preferably has a hollow cylindrical shape, in order to enclose the external hydraulic medium reservoir, which is connected to the internal hydraulic medium reservoir via the axial opening in the piston top part.

A hydraulic medium reservoir, which is protected from return flow of hydraulic medium in the direction of the hydraulic medium supply and which is simultaneously expanded, is suitable especially for tappets, which have a switchable construction by means of a locking mechanism. In this case, an at least partial disruption of the motion transfer of a cam-actuated housing to an inner part of the tappet is enabled, in that the housing can telescope towards the inner part against the force of a lost-motion spring when the locking mechanism is unlocked. Here, the inner part actuates the tappet rod. For the tappet embodied in this way, typically only a limited installation space is available for the compensating piston due to the additional tappet part, so that the hydraulic medium reservoir expanded in the sense of the invention can provide for the first time a sufficiently large hydraulic medium volume to the working chamber.

In addition, the invention can also be used advantageously for tappets, which are arranged in an OHV construction of the internal combustion engine, because the compensating piston must cover a relatively large path between the lowered position and its working position for a correspondingly large need for refilling the working chamber with hydraulic medium due to the considerable and summing component tolerance chain of the OHV construction. Nevertheless, the invention can be used anywhere a sufficiently large hydraulic medium reservoir protected from draining is to be provided at all times to the working chamber of the valve lash compensating device. In this respect, the invention is then also effective, especially when a longitudinal axis of the force transmitting device mounted in the internal combustion engine is inclined relative to the direction of the force of gravity. In this case, the hydraulic medium reservoir can be protected from draining and can be simultaneously expanded sufficiently even for extremely inclined positions of the force transmitting device.

BRIEF DESCRIPTION OF THE DRAWINGS

Additional features of the invention result from the following description and from the drawings, in which the force transmitting device according to the invention is shown using an example with reference to a tappet valve drive in an OHV construction. Shown are.

DETAILED DESCRIPTION OF THE DRAWINGS

Figure 1:
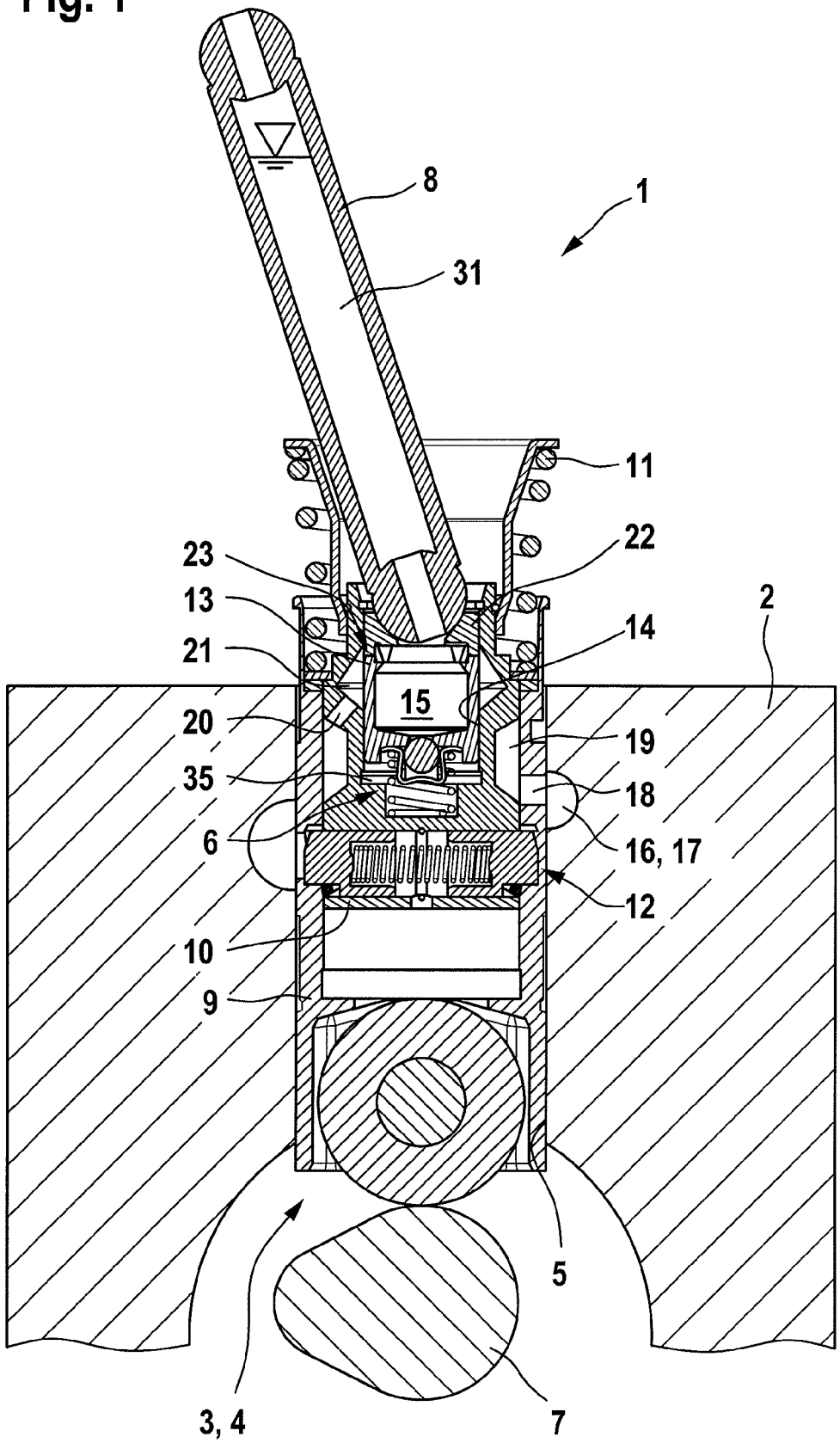
FIG. 1 a cross-sectional view of the tappet valve drive mounted in the internal combustion engine in longitudinal section, FIG. 2 a hydraulic equivalent circuit diagram of the valve plate, FIG. 3 an enlarged representation of the valve plate in its first position, and FIG. 4 an enlarged representation of the valve plate in its second position.

FIG. 1 discloses a cross-section of a valve drive 1 of an internal combustion engine 2. Shown is a force transmitting device 4, which is embodied as a tappet 3 and which is mounted in a hollow cylindrical guide 5 of the internal combustion engine 2 so that it can move longitudinally. The tappet 3 is clamped by a hydraulic valve lash compensating device 6 between a cam 7 of the internal combustion engine 2 and a tappet rod 8 in the longitudinal or lifting direction, as is known to the technical world. The tappet 3 shown here further offers the ability to close a gas-exchange valve, which is actuated by the valve drive 1 but which is not shown, such that the movement transfer of the stroke coming from the cam 7 to the tappet rod 8 is disrupted by the tappet 3. For this purpose, a housing 9 of the tappet 3 can telescope towards an inner part 10 against the force of a lost-motion spring 11. For transferring the lift of the cam 7 to the tappet rod 8, the housing 9 is coupled with a positive lock to the inner part 10 in the extended position of the tappet 3 by means of a locking mechanism 12 according to the representation. The potentials that can be produced with the variability of the tappet 3 in terms of fuel consumption and exhaust gas behavior of the internal combustion engine 2 are also known to someone skilled in the field of internal combustion engines.

However, for providing such a switchable tappet 3, it is to be noted that typically only a considerably limited installation space is made available to a hollow cylindrical compensating piston 13 of the valve lash compensating device 6. This is based on the fact that the compensating piston 13 can now be arranged in an inner sleeve surface 14 of the inner part 10 guided in the housing 9, with the radial installation space of the compensating piston 13 being reduced by approximately the sum of the housing wall thicknesses of the inner part 10 surrounding the compensating piston 13. In this respect, an internal hydraulic medium reservoir 15 directly enclosed by the compensating piston 13 also has a significantly limited volume relative to non-switchable tappets.

For supplying the valve lash compensating device 6, a hydraulic medium supply 16 is also used, which provides pressurized hydraulic medium in the form of an oil gallery 17 intersecting the guide 5 when the internal combustion engine 2 is running. At least in the shown base circle phase of the cam 7, the hydraulic medium is led via a supply opening 18 arranged in the housing 9 of the tappet 3, an outer annular channel 19, and also a rising bore 20 into an inner annular channel 21, which is formed on the inner jacket surface 14 of the inner part 10. The inner jacket surface 14 is used for longitudinally moving guidance of the compensating piston 13, and also of a piston top part 22, which is supported on one end section 23 of the compensating piston 13 and which carries the tappet rod 8 in an articulated way. As shown in the enlarged FIGS. 3 and 4, the hydraulic medium is then led via front-side recesses 24 on the end section 23 of the compensating piston 13 into an annular space 25 and from there into the internal hydraulic medium reservoir 15 according to the position of a valve plate 26.

The valve plate 26 can move axially between a base 27 of the piston top part 22 facing the compensating piston 13 and an annular surface 28 of the compensating piston 13 facing the base 27. Here, the annular space 28 is formed by a cylindrical depression 29 on the end section 23, while an axial opening 30, which is in fluid connection with an external hydraulic medium reservoir 31 formed by the hollow cylindrical tappet rod 8, extends through the base 27 of the piston top part 22. To prevent a hydraulic short circuit between the front-side recesses 24 of the compensating piston 13 and the external hydraulic medium reservoir 31, the valve plate 26 is surrounded on an outer peripheral surface 32 in a sealing gap way by an inner sleeve surface 33 of the piston top part 22.

Figure 3:
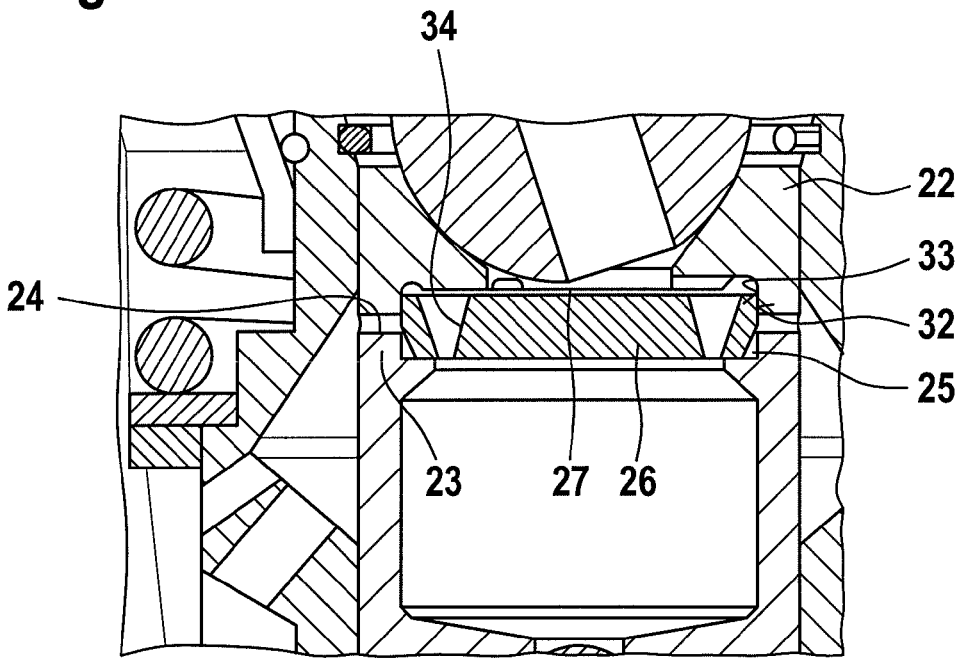

Because the hydraulic medium supply 16 is in the non-pressurized state when the internal combustion engine 2 is stopped, the valve plate 26 assumes a first position according to FIG. 3 just due to the effect of the force of gravity. In this first position, the valve plate 26 is sealed both radially opposite the inner sleeve surface 33 of the piston top part 22 and also axially opposite the annular surface 28 of the compensating piston 13. Consequently, a return flow of hydraulic medium via the front-side recesses 24 of the compensating piston 13 in the direction of the hydraulic medium supply 16 is possible neither from the internal hydraulic medium reservoir 15 nor from the external hydraulic medium reservoir 31. In contrast, however, both hydraulic medium reservoirs 15, 31 are connected to each other via openings 34 in the valve plate 26, so that an expanded and sufficiently large hydraulic medium volume is available to a working chamber 35 of the valve lash compensating device 6 defined by the compensating piston 13 during the starting phase of the internal combustion engine 2.

Figure 4:
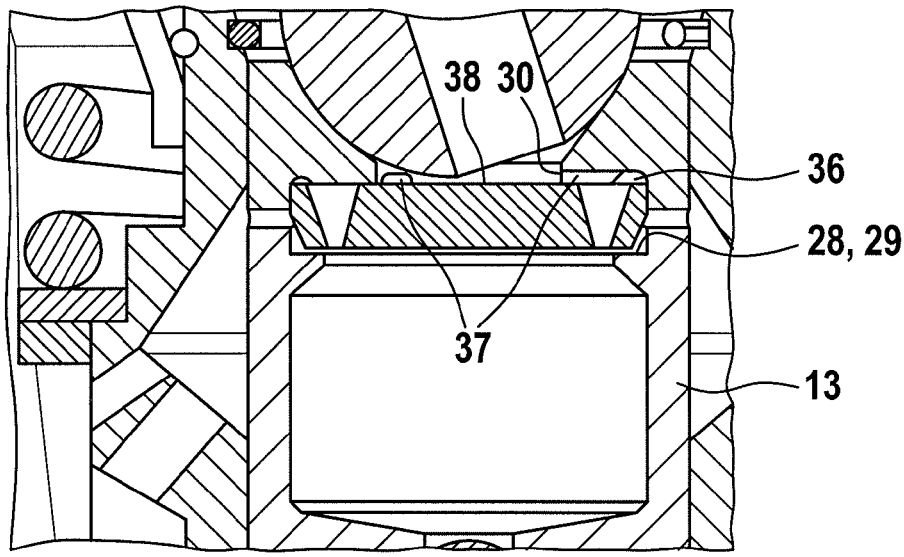

The starting phase of the internal combustion engine 2 leads to a buildup of pressure in the hydraulic medium supply 16 and consequently also to a buildup of pressure in the annular space 25, which is defined in the first position of the valve plate 26 by its tapering outer peripheral surface 32, as well as the annular surface 28. Consequently, an increase in the pressure of the hydraulic medium in the annular space 25 leads to an application of force on the valve plate 26 in the direction of the base 27 of the piston top part 22 and to a change in the arrangement of the valve plate 26 into its second position, as shown in FIG. 4. In this second position, the valve lash compensating device 6 is supplied in a conventional way via the hydraulic medium supply 16 of the internal combustion engine 2, in that the hydraulic medium is led via the front-side recesses 24 and past the annular surface 28 of the compensating piston 13 into the internal hydraulic medium reservoir 15 and finally into the working chamber 35.

An additional functional feature of the shown valve plate 26 is provided by the fact that in their second position, the flow of hydraulic medium directed towards the external hydraulic medium reservoir 31 is throttled. In contrast, the hydraulic medium transfer from the external hydraulic medium reservoir 31 to the internal hydraulic medium reservoir 15 in the first position of the valve plate 26 is performed essentially throttle free. This is useful, because on one side a limited volume flow is sufficient for refilling the external hydraulic medium reservoir 31 and on the other side this hydraulic medium flow should also be used for lubricating adjacent valve components, without generating a significant pressure drop in the hydraulic medium supply 16. The adjacent valve train components involve, for example, the contact positions between the piston top part 22 and the tappet rod 8 or the tappet rod 8 and a subsequent, not shown valve lifter. The throttling by means of the valve plate 26 is performed in the second position such that the openings 34 of the valve plate 26 do not communicate directly with the axial opening 30 in the piston top part 22, but instead open into an annular channel 36, which extends on the base 27 of the piston top part 22 and which connects to the axial opening 30 via low cross-sectional and throttling radial channels 37. Constructions of the valve plate 26 acting simultaneously with reference to their throttling function are also given in that the annular channel 36 and the radial channels 37 extend alternatively, additionally, or alternately into a front side 38 of the valve plate 26 facing the base 27.

Figure 2:
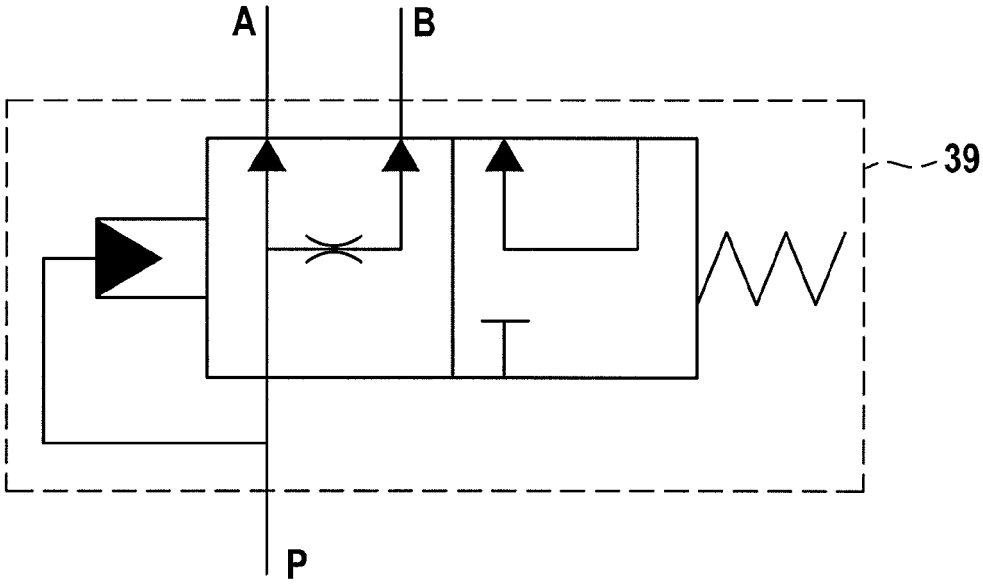

As shown in FIG. 2 with reference to a hydraulic equivalent circuit diagram, the valve plate 26 in this expanded functionality corresponds to a control element of a 3/2 path valve 39, which is controlled passively via hydraulic medium pressure and which controls the hydraulic connections between three ports in its two positions. The ports involve the hydraulic medium supply 16 designated with P, the internal hydraulic medium reservoir 15 designated with A, and also the external hydraulic medium reservoir 31 designated with B. Thus, in the first position of the valve plate 26, a return flow of hydraulic medium is prevented both from the internal hydraulic medium reservoir A and also from the external hydraulic medium reservoir B in the direction of the hydraulic medium supply P, while the external hydraulic medium reservoir B is coupled essentially throttle free to the internal hydraulic medium reservoir A and is made available to the working chamber 35 as additional hydraulic medium volume. The reversing process is performed in the form of a change in arrangement of the valve plate 26 from the first position into the second position passively by pressurizing the hydraulic medium in the annular space 25. After the change in arrangement, the internal hydraulic medium reservoir A is connected conventionally to the hydraulic medium supply P, while a flow of hydraulic medium directed towards the external hydraulic medium reservoir B is throttled.

Although the present invention has been described with reference to a preferred embodiment, it is not restricted to this embodiment, but instead it can also obviously be used for other force transmitting devices, such as, for example, cup tappets with hydraulic valve lash compensating elements, as well as hydraulic support and plug-in elements, each with or without variability.

LIST OF REFERENCE SYMBOLS

| List of reference symbols | |
|---|---|
| 1 | Valve drive |
| 2 | Internal combustion engine |
| 3 | Tappet |
| 4 | Force transmitting device |
| 5 | Guide |
| 6 | Valve lash compensating device |
| 7 | Cam |
| 8 | Tappet rod |
| 9 | Housing |
| 10 | Inner part |
| 11 | Lost-motion spring |
| 12 | Locking mechanism |
| 13 | Compensating piston |
| 14 | Inner sleeve surface |
| 15 | Internal hydraulic medium reservoir |
| 16 | Hydraulic medium supply |
| 17 | Oil gallery |
| 18 | Supply opening |
| 19 | Annular channel |
| 20 | Rising bore |
| 21 | Annular channel |
| 22 | Piston top part |
| 23 | End section |
| 24 | Recess |
| 25 | Annular space |
| 26 | Valve plate |
| 27 | Base |
| 28 | Annular surface |
| 29 | Depression |
| 30 | Axial opening |
| 31 | External hydraulic medium reservoir |
| 32 | Outer peripheral surface |
| 33 | Inner sleeve surface |
| 34 | Opening |
| 35 | Working chamber |
| 36 | Annular channel |
| 37 | Radial channel |
| 38 | Front side |
| 39 | 3/2 path valve |

The invention claimed is:

1. Force transmitting device for a valve drive of an internal combustion engine with a hydraulic valve lash compensating device, with the force transmitting device having a hollow cylindrical compensating piston, which on one end defines a working chamber of the valve lash compensating device and on an other end encloses an internal hydraulic medium reservoir, which is used to supply the working chamber, which is connected to a hydraulic medium supply of the internal combustion engine, and which is protected from a return flow of hydraulic medium in a direction of the hydraulic medium supply by a valve plate that can be pressurized and that can move axially to prevent the return flow from the internal hydraulic medium reservoir to the hydraulic medium supply, the valve plate interacts in a sealing way with an axial annular surface of the compensating piston for a non-pressurized hydraulic medium supply, the valve plate has one or more openings, which connect the internal hydraulic medium reservoir to an external hydraulic medium reservoir for a non-pressurized hydraulic medium supply.

2. Force transmitting device according to claim 1, wherein the valve plate is arranged between a base of a piston top part located on an end section of the compensating piston, and the annular surface of the compensating piston facing the base, and is enclosed on an outer peripheral surface via a sealing gap by an inner sleeve surface of at least one of the compensating piston or of the piston top part.

3. Force transmitting device according to claim 2, wherein the annular surface is formed by a cylindrical depression on the end section of the compensating piston.

4. Force transmitting device according to claim 2, wherein only a throttled hydraulic medium path is available to a flow of hydraulic medium directed towards the external hydraulic medium reservoir when the valve plate contacts the base of the piston top part, with the path comprising one or more radial channels, which extend in at least one of the base or a front side of the valve plate facing the base and which connect an annular channel extending in at least one of the base or the front side of the valve plate, to an axial opening of the piston top part, with the openings of the valve plate opening into the annular channel.

5. Force transmitting device according to claim 2, wherein the force transmitting device comprises a tappet, which is mounted in the internal combustion engine so that it can move longitudinally and which transfers a stroke of a cam to a tappet rod mounted in the piston top part in a pivotable way.

6. Force transmitting device according to claim 5, wherein the tappet rod has a hollow cylindrical construction and encloses the external hydraulic medium reservoir, which is connected to the internal hydraulic medium reservoir via an axial opening extending in the piston top part.

7. Force transmitting device according to claim 5, wherein tappet has a switchable construction having a locking mechanism, which enables an at least partial disruption of a movement transfer of a cam-actuated housing to an inner part of the tappet, in that the housing can telescope towards the inner part when the locking mechanism is unlocked, with the inner part actuating the tappet rod.

8. Force transmitting device according to claim 2, wherein only a throttled hydraulic medium path is available to a flow of hydraulic medium directed towards the external hydraulic medium reservoir when the valve plate contacts the base of the piston top part, with the path comprising one or more radial channels, which extend in the base and which connect an annular channel extending in the base to an axial opening of the piston top part, with the openings of the valve plate opening into the annular channel.

9. Force transmitting device for a valve drive of an internal combustion engine with a hydraulic valve lash compensating device, with the force transmitting device having a hollow cylindrical compensating piston, which on one end defines a working chamber of the valve lash compensating device and on an other end encloses an internal hydraulic medium reservoir, which is used to supply the working chamber, which is connected to a hydraulic medium supply of the internal combustion engine, and which is protected from a return flow of hydraulic medium in a direction of the hydraulic medium supply by a valve plate that can be pressurized and that can move axially, the valve plate interacts in a sealing way with an axial annular surface of the compensating piston for a non-pressurized hydraulic medium supply to prevent the return flow from the internal hydraulic medium reservoir to the hydraulic medium supply, and includes one or more openings, which connect the internal hydraulic medium reservoir to an external hydraulic medium reservoir for a non-pressurized hydraulic medium supply, the valve plate is arranged between a base of a piston top part located on an end section of the compensating piston, and the annular surface of the compensating piston facing the base, and is enclosed on an outer peripheral surface via a sealing gap by an inner sleeve surface of the at least one of the compensating piston or the piston top part;

wherein when the valve plate contacts the annular surface of the compensating piston, the outer peripheral surface of the valve plate which is tapered on a side facing the annular surface defines an annular space connected to the hydraulic medium supply, wherein the annular space is used for applying pressure to the valve plate in a direction of the base of the piston top part.

10. Force transmitting device according to claim 9, wherein the annular space is connected to the hydraulic medium supply via at least one front-side recess on the end section of the compensating piston.

* * * * *